US006108955A

United States Patent [19]

Folsom et al.

[11] Patent Number: 6,108,955

[45] **Date of Patent: *Aug. 29, 2000**

[54] SIGN FOR DISPLAYING CHANGEABLE MESSAGES

[76] Inventors: Lonnie K. Folsom, 1627 33rd Ave. N., St. Cloud, Minn. 56303; Glenn A. Maskiw, 35 Stillmeadow Cove, Winnipeg, Manitoba, Canada, R2R 2R6

[ * ] Notice: This patent is subject to a terminal disclaimer.

[21] Appl. No.: 08/451,552

[22] Filed: May 26, 1995

[51] Int. Cl.[7] ..... G09F 7/02

[52] U.S. Cl. ..... 40/618; 40/620; 40/658

[58] Field of Search ..... 40/618, 620, 611, 40/658, 657; 248/488, 490, 316.7, 500

[56] References Cited

U.S. PATENT DOCUMENTS

| | | | |
|---|---|---|---|
| 2,010,274 | 8/1935 | Pleuthner | 40/618 |
| 2,520,648 | 8/1950 | Newman . | |
| 2,538,056 | 1/1951 | Staaf . | |
| 2,593,621 | 4/1952 | Staaf . | |
| 3,098,272 | 7/1963 | Frye | 40/658 |
| 3,470,640 | 10/1969 | Knowles . | |
| 3,478,997 | 11/1969 | Goss | 248/488 |
| 3,529,373 | 9/1970 | Aaskov . | |
| 3,531,884 | 10/1970 | Adler | 40/618 |
| 3,574,964 | 4/1971 | Ownbey . | |
| 3,797,795 | 3/1974 | Hemgren | 248/316.7 |
| 4,067,536 | 1/1978 | McBeth | 248/316.7 |
| 4,265,040 | 5/1981 | Sarkisian | 40/618 |
| 4,693,026 | 9/1987 | Callahan et al. | 40/618 X |
| 4,698,928 | 10/1987 | Soporowski . | |
| 4,884,351 | 12/1989 | Abramson . | |
| 5,257,472 | 11/1993 | Harnois et al. . | |
| 5,343,646 | 9/1994 | Cobb et al. | 40/585 |
| 5,357,701 | 10/1994 | Grate . | |

*Primary Examiner*—Cassandra H. Davis
*Attorney, Agent, or Firm*—Albert W. Watkins

[57] ABSTRACT

A sign for displaying changeable messages. The sign includes a generally planar backboard having a plurality of tracks affixed thereon. The tracks define channels for receiving first portions of a plurality of interchangeable panels. Affixed to each panel is a visible character. The panels are aligned side-by-side along the tracks such that the visible characters define visible messages. The sign also includes fastening members which extend through second portions of the panels for affixing the second portions to the backboard.

10 Claims, 2 Drawing Sheets

SIGN FOR DISPLAYING CHANGEABLE MESSAGES

FIELD OF THE INVENTION

The present invention relates generally to signs for displaying messages. Specifically, the present invention relates to signs for displaying easily changeable and highly visible messages.

BACKGROUND OF THE INVENTION

It is well known that signs are important advertising tools. However, for signs to be used effectively, they should be highly visible to catch the attention of consumers. Additionally, the messages displayed by signs should be readily changeable to reduce costs associated with updating messages displayed by the signs.

Conventional signs for displaying changeable messages such as those shown in U.S. Pat. Nos. 2,520,648, 2,538,056 and 2,593,621, employ cut-out characters which are aligned within base tracks to form messages. These signs have the disadvantage of increased manufacturing cost due to the use of cut-out characters. Additionally, the base tracks employed by such signs are not intended or designed for use in association with a display board.

Other signs for displaying changeable messages such as those shown in U.S. Pat. Nos. 3,470,640 and 5,357,701, utilize panels which display visible characters. The panels of such prior art signs are mounted on boards behind rigid tracks which are permanently connected to the boards. The rigid tracks secure the tops and bottoms of the panels to the boards. The design of such signs presents problems because the panels are not readily changeable. To exchange panels, the panels must be slid behind the tracks across the faces of the signs. Therefore, to replace central panels, all intervening panels must also be removed from the sign. Additionally, the tracks of such signs are not moveable thereby limiting the panel sizes which may be employed and the variety of potential display arrangements.

What is needed is a sign which can be inexpensively manufactured. What is also needed is an sign for displaying high visibility messages. What is further needed is a sign that displays easily changeable messages. Moreover, what is needed is a sign having a wide variety of display arrangements.

SUMMARY OF THE INVENTION

The present invention relates to a sign for displaying changeable messages. The sign includes a generally planar backboard having a plurality of tracks affixed thereon. The tracks define channels for receiving first portions of a plurality of interchangeable panels. Affixed to each panel is a visible character. The panels are aligned along the tracks such that the visible characters define visible messages. The sign also includes fastening members which engage the second portions of the panels and the backboard for affixing the second portions to the backboard.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
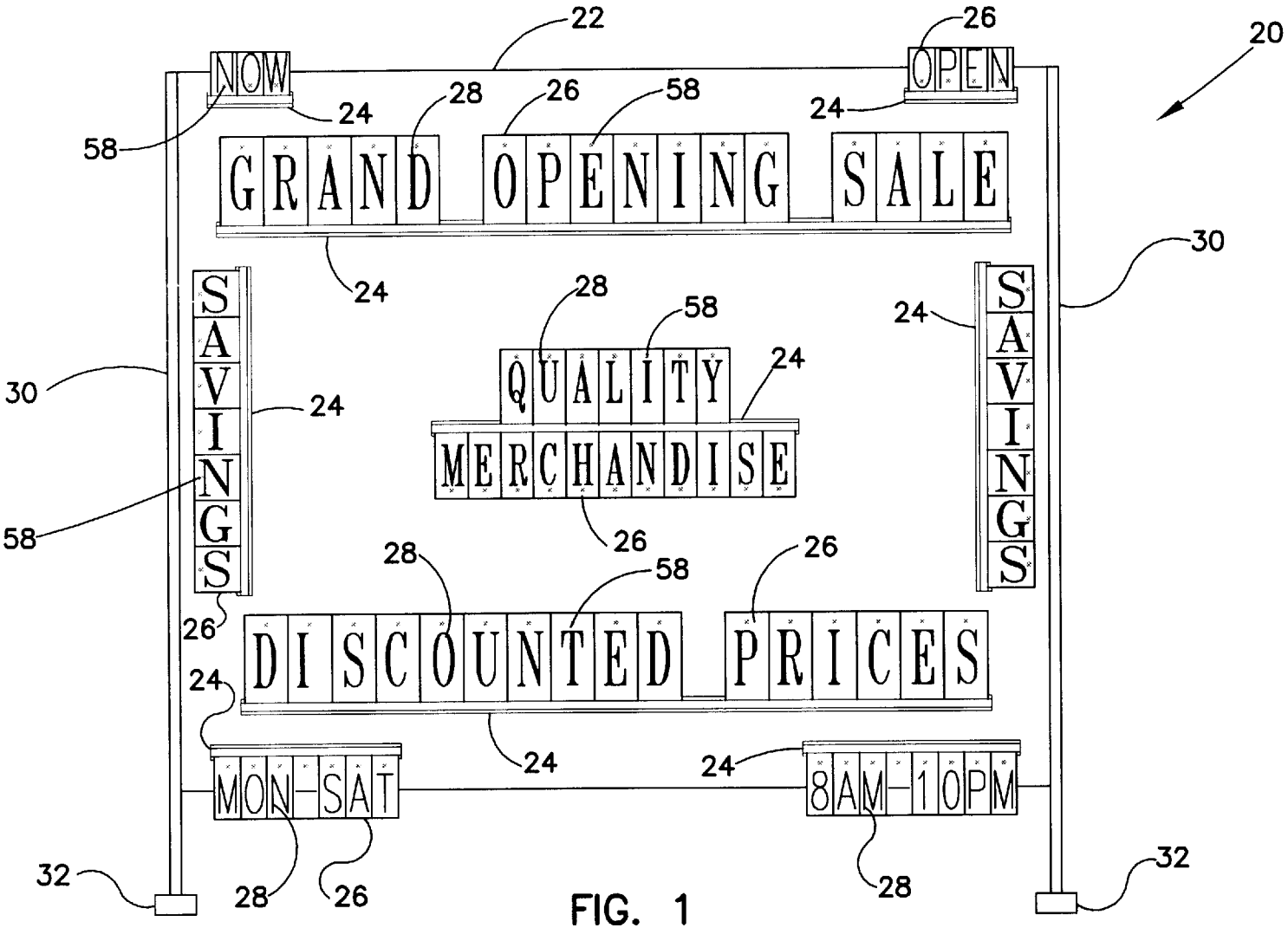
FIG. 1 is a front view of a sign which is illustrative of a sign constructed in accordance with the principles of the present invention.

FIG. 1 illustrates a sign 20 for displaying changeable messages which is an exemplary embodiment of the present invention. The sign 20 includes a generally planar backboard 22 having a plurality of flexible plastic tracks 24 mounted thereon. The sign 20 also includes a plurality of interchangeable panels 26, each having a visible character 28 adhesively affixed thereon. The panels 26 are removably mounted in the tracks 24 for defining the changeable messages. The components of the sign 20 will be individually described in greater detail in the specification which follows.

With regard to the generally planar backboard 22, it is preferred that the backboard 22 be rectangular and substantially rigid. Additionally, it is desired for the backboard to have a generally soft texture such that fastening members such as screws or staples may be driven into the backboard 22 without requiring excessive force or pilot holes. Exemplary materials that have the desired rigidity and softness include plywood, particle board and plastic. Furthermore, it is preferred for the backboard 22 to be a dark color, such as black, in order to enhance the visibility of the visible characters 28.

It is also preferred for the planar backboard 22 to have metal frame members 30 connected to the sides of the backboard 22 for supporting and providing greater rigidity to the backboard 22. It will be appreciated that the metal frame members 30 are connected to the sides of the backboard 22 by conventional fastening techniques such as bolts, screws, nails, or adhesives.

It will be appreciated that it is desirable for the generally planar backboard 22 to be maintained in a generally vertical plane in order to maximize visibility of the sign 20. Therefore, it is preferred for the sign 20 to have a support structure for maintaining the generally planar backboard 22 in a generally vertical plane.

FIG. 1 illustrates an exemplary support structure for maintaining the backboard 22 in a generally vertical plane. The support structure comprises a pair of inverted T-shaped leg irons 32 which are connected to the metal frame members 30 in order to maintain the backboard 22 within a generally vertical plane. It will be appreciated that the T-shaped leg irons 32 illustrated in FIG. 1 are merely illustrative and that a variety of comparable support structures are commonly known in the art. Additionally, it will be appreciated that the planar backboard 22 may be attached to a generally vertical wall surface thereby eliminating the need for any additional support structure for maintaining the backboard 22 within a generally vertical plane.

Figure 3:
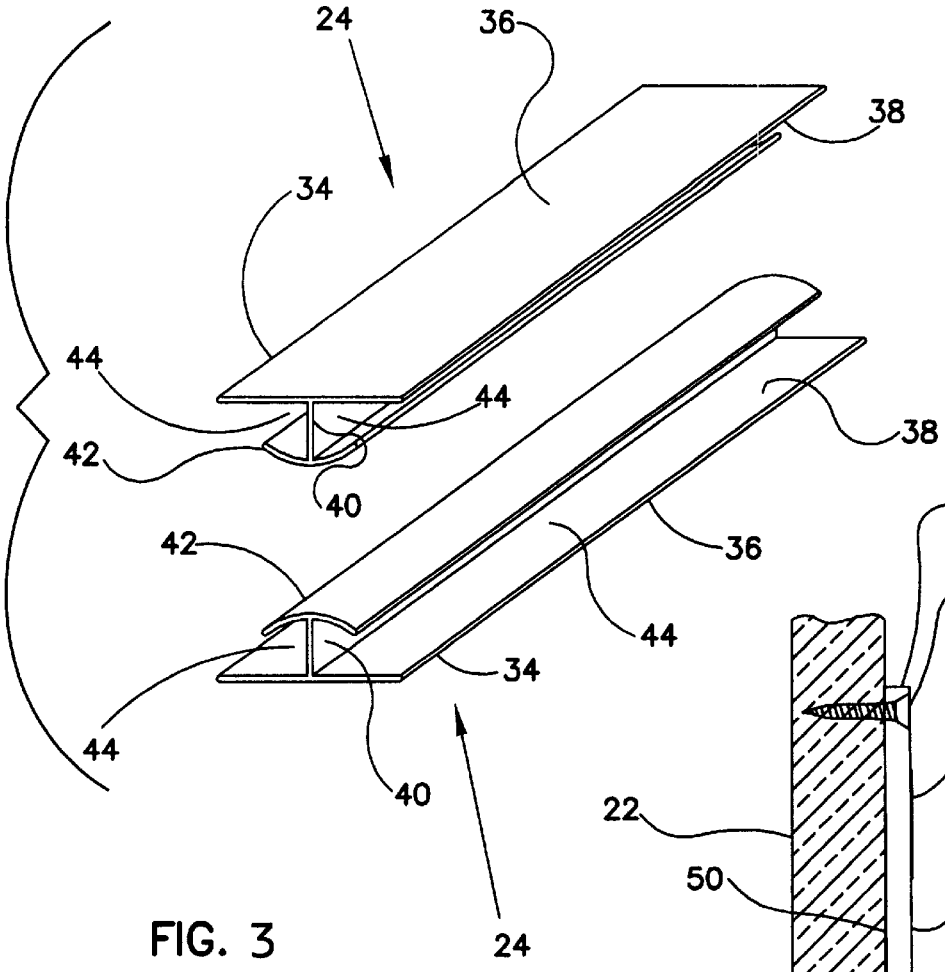
FIG. 3 is a perspective view of exemplary tracks employed by the sign of FIG. 2.
Figure 2:
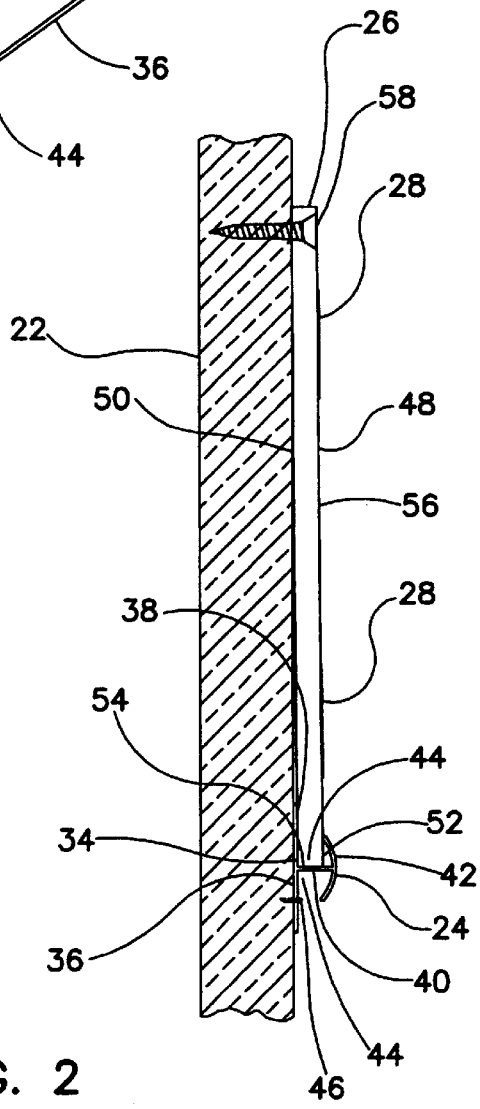
FIG. 2 is a cross-sectional view taken along section line 2—2 of the sign shown in FIG. 1.

The tracks 24 of the sign 20 are preferably constructed of extruded plastic or a similarly flexible material. FIGS. 2 and 3 show that each track 24 preferably includes a flange portion 34 having opposite and generally parallel first and second surfaces 36 and 38. The tracks 24 also include flexible lip portions 42 which are spaced from and opposite to the second surfaces 38 of the flange portions 34. The flexible lip portions 42 are preferably curved slightly toward the flange portions 34.

The tracks 24 further include radial portions 40 extending generally perpendicularly between the second surfaces 38 of the flange portions 34 and the lip portions 42. Preferably, the cross-section of the radial portion 40 and the lip portion 42 of each track 24 is generally T-shaped such that two longitudinal track channels 44 opening in opposite directions are defined by the radial portion 40, the flange portion 34 and lip portion 42 of each track 24. However, it will be appreciated that each track 24 may include only one channel 44.

The tracks 24 are preferably affixed to the backboard 22 by employing affixing members such as staples 46 which are driven through the plastic flange portions 34 of the tracks 24 and into the backboard 22. As affixed, the first surfaces 36 of the flanges 34 are generally parallel to and in contact with the backboard 22. It will be appreciated that the tracks 24 may be affixed to the backboard 22 in a variety of arrangements. For example, FIG. 1 illustrates some of the tracks 24 arranged horizontally on the backboard 22 while others are arranged vertically. It will be appreciated that the tracks 24 may be arranged in an almost unlimited variety of combinations in order to display a wide variety of messages.

It will also be appreciated that because the backboard 22 has a generally soft texture, the tracks 24 may be easily removed from the backboard 22 by pulling on the tracks 24 with sufficient force to withdraw the staples 46 from the backboard 22. The tracks 24 are re-affixed to the backboard 22 by stapling the tracks 24 to a new location on the backboard 22 thereby enabling a user to easily alter the display arrangement of the sign 20.

The panels 26 of the sign 20 are preferably constructed of a relatively soft and yet generally rigid material such as corrugated plastic. The panels 26 are preferably rectangular and have a front face 48 and a rear face 50. The visible characters 28, which include letters, numbers and symbols, are adhesively affixed to the front faces 48 of the panels 26. It is desireable for the visible characters 28 to be made of adhesive-backed vinyl having high visibility neon colors. It will be appreciated that a suitable material is sold by Minnesota Mining and Manufacturing Company under the trade name "Scotchcal Marking Film." It will further be appreciated that by employing panels 26 having a darkened or black front face 48, the visibility of the characters 52 is additionally enhanced.

The panels 26 include first portions 52 having first edges 54 which are inserted into the track channels 44. When the first edges 54 of the panels 26 are inserted into the track channels 44, the slightly curved flexible lips 42 of the tracks 24 are caused to flex away from the flange portions 34 of the tracks 24. As flexed, the lips 42 are biased against the first portions 52 of the panels 26 for firmly retaining the panels 26 within the channels 44. In this manner, the first portions 52 of the panels 26 are effectively secured to the backboard 22 by the tracks 24. Additionally, because the lips 42 are flexible, it will be appreciated that the track channels 44 can accommodate panels 26 of varying thicknesses.

The panels 26 also include second portions 56 upon which the visible characters 28 are affixed. The second portions 56 are secured to the backboard 22 by removable fastening members such as screws 58 which pass through the second portions 56 of the panels 26 and engage the backboard 22 at locations spaced from the first portions 52. Because the panels 26 are preferably constructed of soft corrugated plastic, the screws 58 can be driven through the panels without requiring pilot holes or excessive force. Similarly, because the backboard 22 is preferably constructed of soft textured material, the screws 58 can be driven into the backboard 22 without requiring pilot holes or excessive force. In this manner, the second portions 56 of the panels 26 are held securely against the backboard 22 by the screws 58.

As described above, the panels 26 are attached to the backboard 22 by the two step process of first, inserting the first portions 52 of the panels 26 within the track channels 44 and second, driving fastening members such as screws 58 through the second portions 56 of the panels 26 and into the backboard 22. Similarly, when the message displayed by the sign 20 is to be changed, the panels 26 are detached from the backboard 22 by the two step process of first, removing the fastening members 58 from the backboard 22 and second, withdrawing the first portions 52 of the panels 26 from the track channels 44.

As secured to the backboard 22 by the fastening members 58 and the tracks 24, the rear faces 50 of the panels 26 face the backboard 22 and the front faces 48 of the panels 26 face outward from the backboard 22 such that the visible characters 28 are displayed. The panels 26 are preferably uniformly aligned side-by-side along the tracks 24 such that the visible characters 28 define visible messages. The tracks 24 are designed such that the panels 26 can be quickly arranged within the channels 44 in order to form uniformly aligned and aesthetically pleasing visible messages.

Because the tracks 24 are easily rearranged on the backboard 22, the sign 20 can be used to display unlimited message arrangements. For example, the tracks 24 can be arranged such that the panels 26 are aligned along the tracks 24 to display vertical, horizontal, or slanted messages. Additionally, the tracks 24 can be spaced to accommodate panels 26 having different sizes thereby allowing messages displayed by the sign 20 to have visible characters 28 of varying size. Furthermore, the panels 26 can be arranged such that they extend above the top of the backboard 22 or below the bottom of the backboard 22.

With regard to the foregoing description, it is to be understood that changes may be made in detail, especially in matters of shape, size and arrangement of the parts without departing from the scope of the present invention. It is intended that the specification and depicted embodiment be considered exemplary only, with a true scope and spirit of the invention being indicated by the broad meaning of the following claims.

What is claimed is:

1. A sign for displaying changeable messages, comprising:

a generally planar backboard;

a flexible track affixed to said backboard and providing an elastic panel receiving channel;

a panel for displaying a visible character of said changeable messages, said panel having a first edge adapted to be inserted manually into said channel for retaining said panel to said backboard and precisely locating said panel relative to said flexible track; and a discrete fastener distal to said first edge rigidly securing said panel to said backboard.

2. The sign of claim 1 wherein said discrete fastener further comprises a screw.

3. The sign of claim 1 wherein said panel further comprises corrugated plastic.

4. The sign of claim 3 wherein said panel extends beyond a perimeter of said backboard.

5. The sign of claim 1 further comprising a removable and adjustable fastener affixing said flexible track to said backboard.

6. The sign of claim 1 further comprising a high-contrast vinyl pattern adhered to said corrugated plastic, thereby defining said visible character.

7. A method for changing the message displayed upon a changeable message sign having a backing board supporting a track for locating a plurality of visible character panels with respect to said track, comprising the steps of:

selecting a desired visible character panel from an assortment of visible character panels containing a variety of visible characters displayed thereon;

locating an undesired visible character panel atttached to said changeable message sign for replacement by said desired visible character panel;

releasing a fastener from rigidly fastening said backing board to said undesired visble character panel to allow said undesired visible character panel to slide relative to said backing board;

sliding said undesired visble character panel in a direction transverse to and away from said track, thereby releasing said visible character panel from said track;

sliding said desired visible character panel in a direction transverse to and towards said track adequately for said track to retain said visible character panel against said backing board; and installing a fastener to rigidly fasten said backing board to said desired visible character panel and prevent relative motion therebetween.

8. The method for changing the message displayed upon a changeable message sign of claim 7 wherein said step of sliding is further comprised by sliding until a minor edge of said visible character panel contacts said track.

9. The method for changing the message displayed upon a changeable message sign of claim 7 wherein said panel extends beyond a perimeter of said backing board.

10. The method for changing the message displayed upon a changeable message sign of claim 7 wherein said panel resiliently recieves said fastener.

* * * * *